US005566636A

United States Patent [19]

Wolf et al.

[11] Patent Number: 5,566,636

[45] **Date of Patent: *Oct. 22, 1996**

[54] OFF SHORE MOORING SYSTEM

[75] Inventors: Christian V. Wolf, Houston; Thomas S. Burns, Sugarland, both of Tex.

[73] Assignee: Reading & Bates Development Co., Houston, Tex.

[ * ] Notice: The term of this patent shall not extend beyond the expiration date of Pat. No. 5,390,618.

[21] Appl. No.: 391,442

[22] Filed: Feb. 21, 1995

Related U.S. Application Data

[63] Continuation-in-part of Ser. No. 62,945, May 17, 1993, Pat. No. 5,390,618.

[51] Int. Cl.[6] ..... B63B 21/50

[52] U.S. Cl. ..... 114/230; 114/293

[58] Field of Search ..... 114/293, 101, 114/230, 264, 265; 166/352; 405/224, 224.3, 224.4; 242/179 R; 254/389; 441/3–5

[56] References Cited

U.S. PATENT DOCUMENTS

| | | | |
|---|---|---|---|
| 1,828,269 | 10/1931 | Wright | 254/389 |
| 3,151,594 | 10/1964 | Collipp | 114/230 |
| 4,170,186 | 10/1979 | Shaw | 114/293 |
| 4,430,023 | 2/1984 | Hayes et al. | 254/389 |
| 5,390,618 | 2/1995 | Wolff et al. | 114/230 |

FOREIGN PATENT DOCUMENTS

| | | | |
|---|---|---|---|
| 0150891 | 7/1986 | Japan | 114/293 |

*Primary Examiner*—Edwin L. Swinehart

[57] ABSTRACT

A mooring system for mooring a turreted vessel off-shore, which comprises: line pulling equipment mounted in the vessel turret; a block located in the water at a depth below expected wave action and at a distance from the vessel; a mooring line extending from the puling equipment, through a fairlead at the bottom of the vessel turret, through the block and back for releasable attachment to the vessel; and mooring tackle attached to the block and extending away from the vessel to an anchor. The mooring line and mooring tackle form a catenary between the vessel and the anchor which has a curve adapted to maintain the anchor securely attached to the sea bottom, and to maintain the block below the depth of expected wave action.

4 Claims, 1 Drawing Sheet

OFF SHORE MOORING SYSTEM

BACKGROUND OF THE INVENTION

This Application is a Continuation-in-Part of application Ser. No. 08/062,945, filed May 17, 1993 now U.S. Pat. No. 5,390,618, issued Feb. 21, 1995.

FIELD OF THE INVENTION

The present invention relates to systems and methods for mooring vessels offshore. Particularly, the present invention relates to systems and methods for mooring vessels which will be expected to remain on station for extended periods of time, or perhaps permanently, under weather conditions which may include heavy seas, high winds and strong currents. More particularly, the present invention relates to systems and methods for mooring turreted vessels employed as drilling vessels, tenders, oil production vessels and oil storage vessels.

BACKGROUND OF THE INVENTION

A mooring system for vessels intended to be moored offshore is a large, expensive set of equipment comprising several thousand feet of mooring line comprising chains and wire lines, a windlass or winch with redundant braking systems for deploying, tensioning and retrieving the mooring line, fairleads for directing the mooring lines, line swivels to prevent kinks in the mooring chains, anchors (or alternatively a mooring piling) for providing holding power to keep the vessel moored on station, as well as a variety of specialized equipment to satisfy various mooring conditions. For each mooring point of a vessel, separate mooring tackle is required. The mooring line of each mooring tackle will be attached to an anchor, or, in some circumstances, to a piling driven into the bottom. Turreted vessels which are expected to remain on station for extended periods of time, may have from six to sixteen mooring points.

Mooring systems are designed to industry standards to ensure that the mooring systems provide the holding power required to withstand expected weather and sea conditions. Typically, mobile offshore vessels, such as drill ships and semi submersibles engaged in drilling operations, are designed to withstand maximum weather conditions expected during a 5–10 year period within their areas of expected operation. On the other hand, floating production vessels of similar size and type are designed for maximum weather conditions expected during a 50–100 year period in their area of intended operation. Consequently, floating production vessels are designed with two to three times the mooring strength of drilling vessels.

Increased attention to personnel safety and environmental protection is creating a trend toward requiring increased mooring strengths for mooring systems, particularly for vessels in offshore oil and gas drilling service. Additionally, with current economic conditions, operators often wish to employ drilling vessels, in areas having more severe weather conditions than conditions for which the vessel mooring systems were initially designed. Also, operators are finding it economically attractive to convert existing drilling vessels into production vessels which require much stronger mooring systems. In each of these circumstances means must be found for increasing the strength of the existing vessel mooring systems, or the existing mooring systems must be replaced with stronger mooring systems. Replacement of existing vessel mooring systems is doubly expensive. Not only must the new, stronger mooring systems be procured and installed, the existing mooring systems must be removed and scrapped.

Each mooring system for large vessels may cost in the millions of dollars. For vessels having eight or more mooring systems, mooring system may cost in the tens of millions of dollars.

DESCRIPTION OF PERTINENT ART

In the past, tender barges, designed for mooring along side fixed drilling and production platforms in the Gulf of Mexico, employed a plurality of mooring systems in order to hold the tenders on station adjacent the platforms with little lateral movement. The tenders employed up to eight mooring points for attachment to anchors or, very often, to permanently set anchor piling driven into the bottom. Each anchor or piling had a mooring line running upward and attached to a raft buoy at the water surface. Each raft buoy was large enough to hold its mooring line on the surface at all times, including times when a tender mooring line was attached and tensioned to moor the tender in place. A large sheave was mounted on each raft buoy. T o moor a tender, a soft line was run out from the tender, through the sheave and back to the tender. This soft line was attached to a vessel mooring line which was then pulled out through the sheave and back to the tender where the end of the vessel mooring line was tied-off. This step was repeated for each sheave on each raft buoy. The vessel mooring lines were then taken-up and tensioned to position the tender alongside the platform. This mooring system was designed for shallow water and mild weather conditions. In heavy weather, the tender could slip its moorings for a tow to port by releasing the end of each vessel mooring line and pulling the vessel mooring lines back to the tender through the raft buoy sheaves.

This method for mooring tenders has several disadvantages which make it not useful for mooring larger vessels in deep waters or in heavy seas. The raft buoys, located at the water surface, were subject to wave action. In heavy seas, the raft buoys tended to lift the anchors, if anchors were used, or break the mooring lines if the anchors held to the sea bed, or if mooring piling were used instead of anchors. Additionally, the mooring lines from the tender to the raft buoys were at water surface level, subject to wave action, and were an obstruction to supply and service boats

SUMMARY OF THE INVENTION

An object of the present invention is to provide improved mooring systems for off shore mooring of turreted vessels.

Another object of the present invention is to provide economical mooring systems requiring windlasses or winches of reduced pulling power compared to conventional mooring systems.

Another object of the present invention is to provide modifications to existing mooring systems for increasing mooring strength and effective pulling power without replacing existing winch, windlass and brake equipment.

According to the present invention, the improvement to a vessel mooring system includes a mooring line from the vessel mooring system reeved through a sheave mounted in a sheave block having a clevis for attachment to an anchor line. The free end of the mooring line, after being reeved through the sheave, is returned and secured to the vessel. The sheave block, run out a distance from the vessel, is attached to an anchor line. When positioned for mooring, the sheave block is deployed in the water at a depth below the hull of the vessel sufficient to keep the sheave block both clear of the sea bed (or any obstructions) and clear of wave action during the roughest seas expected at the mooring location. This improvement to mooring systems allows the pulling power of the windlass and winch equipment upon the anchor lines to be effectively doubled without necessity of replacing on-board components of the mooring systems. The improvement of the present invention may be used with new mooring systems, thus allowing winches and windlasses with less pulling power to be used, or maybe used to refurbish existing mooring systems to increase the effective pulling power of existing winches and windlasses.

These and other advantages of the present invention will become apparent in the detailed description of the invention which follows.

DETAILED DESCRIPTION OF A PREFERRED EMBODYMENT OF THE PRESENT INVENTION

The improvement of the present invention may be applied to existing mooring systems of turreted vessels for increasing the mooring strength of the mooring systems while retaining the major portion of the existing on board mooring equipment such as windlasses, winches, brakes, guide sheaves, fairleads, etc. Also, the improvement of the present invention may be applied to new mooring systems placed on vessels, thereby allowing use of on board mooring equipment having less pulling power than would otherwise be required with other known mooring systems. In either case, cost savings due to use of the improvements of the present invention will be substantial. In some cases, for large vessels with multiple mooring points, cost savings will be in the tens of millions of dollars.

The present invention will be described below in this specification with reference to a turreted drilling vessel. A turreted vessel has a hull and has a turret extending through the hull from the upper deck through the bottom of the hull. The turret provides an opening from the vessel upper deck into the water below the vessel hull. The vessel is rotatable around the turret such that the vessel bow may be headed into the wind or seas without interferring with drilling or other operations conducted through the turret.

Figure 1:
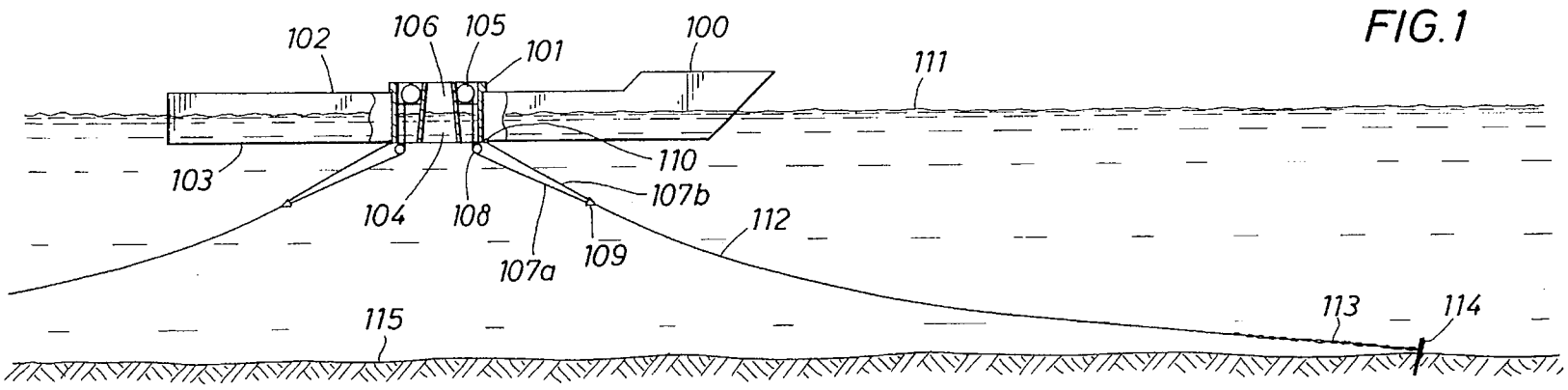
FIG. 1 of the drawings is a schematic representation of a turreted vessel mooring system embodying the improvements of the present invention.

Turreted vessels are commonly equipped with six to sixteen self contained chain, wire line or combination chain-wire line, sets of mooring tackle mounted symmetrically about the interior of the vessel turret on support members located above the vessel waterline. The equipment and tackle for all mooring points of a particular turreted vessel are generally substantially identical, therefore the description below with reference to FIG. 1 will be limited to the mooring equipment for one mooring point for such vessel. It will be understood that the mooring system shown in FIG. 1 is a simple one with few components, selected to allow a focus on the improvements of the present invention without an undue amount of description being devoted to components which may be present in mooring systems, but which are not necessary for understanding of the improvements of the present invention. Concomitantly, it will be understood that a variety of additional mooring system components, both vessel mounted equipment and mooring tackle, may be employed in mooring systems embodying the improvement of the present invention.

In FIG. 1, vessel hull 100 is shown in section view. Turret 101, extends through vessel hull 100 from the vessel upper deck through the vessel hull bottom 103, defining an opening from vessel upper deck 102 into the water below vessel hull 100.

In FIG. 1, winch 105 is mounted on a support member 106 within turret 101 for deploying and retrieving vessel mooring line 107. Winch 105 is representative of mooring line pulling equipment employed in vessel mooring systems. Such pulling equipment may comprise a single winch, as shown by winch 105, or may comprise a chain windlass or combinations of winches, linear winches traction winches, storage winches, windlasses, hydraulic chain pullers and other pulling equipment. For describing the improvement of the present invention, winch 105 is sufficiently representative of such pulling equipment. Winch 105 is equipped with a brake system, not shown, for holding mooring line 107 under tension during periods when vessel 100 is moored. Winch 105 has a pulling power not greater than the break strength of mooring line 107, and preferably about one-half the break strength of mooring line 107 for safety considerations.

In FIG. 1,vessel mooring line 107 and mooring line 112 comprise high strength wire line (stranded cable) and/or chain. Break strength of the chain and wire line components of the mooring lines are about equal. When used in combination, chain and wire line are linked by conventional means in various linear combinations to suit mooring conditions encountered. Either wire line only, or chain only, or combinations of chain and wire line may be employed in vessel mooring line 107 and mooring line 112.

For drilling and production vessels such as vessel 100, a plurality of mooring lines and anchors are deployed radially away from the vessels to resist environmental forces due to wind, waves and sea currents from any direction. This arrangement of mooring lines is known as a "spread mooring system". The primary purpose of the spread mooring system is to hold a moored vessel within a limited circle about the center of its station. For example, a semi submersible drilling vessel is held in a limited circle about the well center on the sea floor to allow drilling operations to proceed as continuously as possible. By limiting permitted excursions from this center, and by managing differential mooring tensions between the mooring lines, this spread mooring system provides the restoring force needed to maintain the vessel on station under the influence of upsetting weather conditions and sea currents. Generally, the mooring lines and anchors are symmetrically spread around the vessel.. Under certain conditions, however, other mooring patterns may be used. For example, a ship may employ only two mooring lines with anchors deployed to hold the ship's bow into the prevailing wind or current. Mooring line diameters, lengths and distance to anchor should be based upon the most severe storm and sea conditions that may be encountered at the mooring station.

In FIG. 1, winch 105 is mounted on support member 106 inside turret 101 and provides pulling power and braking for deploying, tensioning and holding vessel mooring line 107. Vessel mooring line 107 is connected to winch 105, and has a free end. From winch 105, a first portion 107*a* of vessel mooring line 107 passes down the inside of turret 101, through first fairlead 108. First fairlead 108 is attached to the bottom of turret 101 at about the bottom of vessel hull 100. Vessel mooring line 107*a* changes direction in first fairlead 108, and runs out to block 109. Vessel mooring line 107 changes direction in block 109 and a second portion 107*b* of vessel mooring line 107 runs from block 109 to a second fairlead 110 attached to the lower end of turret 101 from which vessel mooring line 107*b* extends upward inside turret 101 where the vessel mooring line free end is releasably attached and is tied off above vessel water line 111. A drawing of block 109, showing its preferred components is shown in FIG. 3, and is described below.

Second fairlead 110 is attached to the interior of turret 101 and is laterally spaced from first fairlead 108 to prevent entanglement or chaffing between portion 107*a* and portion 107*b* of vessel mooring line 107.

First fair lead 108 and second fairlead 110 each may comprise a sheave, which rotates as mooring line 107 is pulled through, or a closed chock, which is a curved metal apparatus around which mooring line 107 is pulled, or a bending shoe having low friction surfaces or having beatings over which the vessel mooring line may run. The fairleads 108 and 110 may be swivel mounted on the bottom of turret 101 for allowing the fairleads 108 and 110 to be open in the direction in which the vessel mooring line 107 is running out from the vessel. The purpose of fair leads 108 and 110 is to provide a radius of curvature which will prevent mooring line 107 from crimping as it changes direction in passing from vessel 100 into mooring position.

In FIG. 1, the free end of mooring line 107*b*, extending upward from second fairlead 110, may be any convenient means for releasably attaching the free end of vessel mooring line 107 to turret 101, such as a bollard, a pad eye, a "dead man", etc. such line attachment means is positioned in a location conveniently reached by ships personnel for releasing vessel mooring line 107, such that vessel 100 may slip its mooring if necessary.

In the preferred embodyment of the improvement of the present invention shown in FIG. 1, first fairlead 108 and second fair lead 110 each may comprise a sheave, a closed chock, a fairlead or a bending shoe, or may comprise other fairlead means. Preferably, first fairlead 108 and second fairlead 110 each comprise a bending shoe.

In FIG. 1, Block 109 is connected to the upper end of mooring line 112. As desired the connection may include a swivel, not shown, for preventing mooring line 112 and vessel mooring lines 107*a* and 107*b* from twisting. The lower end of mooring line 112 is attached to the upper end of anchor chain 113. The lower end of anchor chain 113 is attached to anchor 114. Anchor 114 may comprise a retrievable anchor, as is commonly used to moor vessels, or alternatively may comprise an anchor piling set into the sea bed 115 of the body of water in which the vessel is moored. Anchor 114, whether a retrievable anchor or alternatively anchor piling, is firmly set in the sea bed 115 for providing holding power for moored vessel 100.

Figure 2:
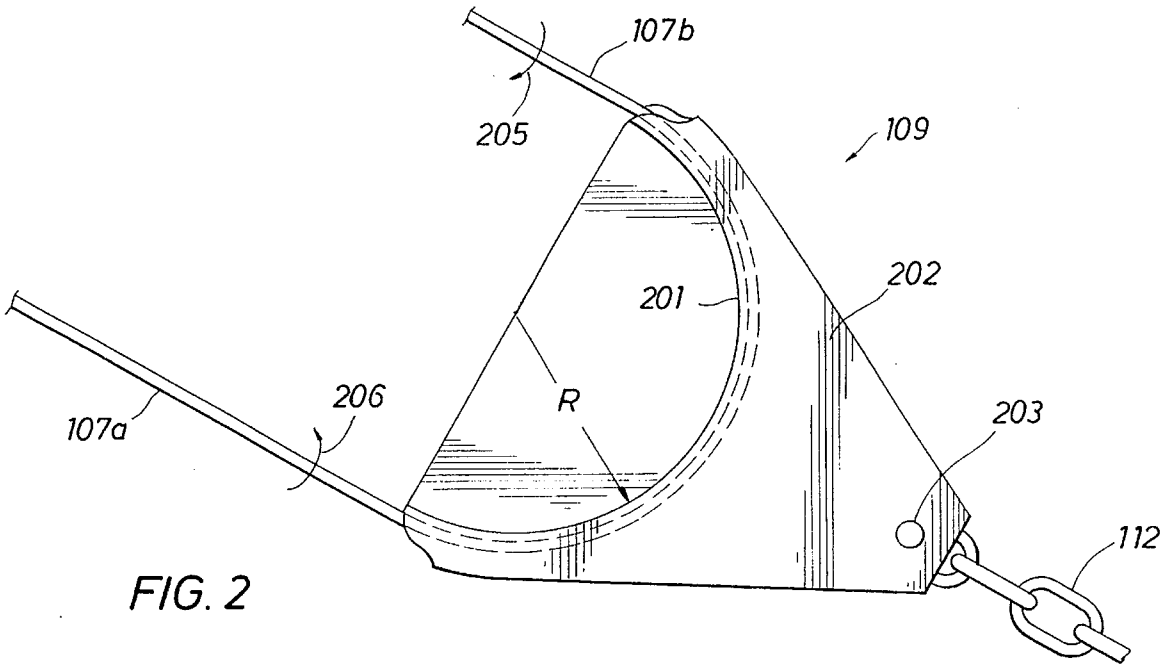
FIG. 2 of the drawings is a schematic representation of a typical block which may be employed in the improvements of the present invention.

FIG. 2 is a detail showing block 109 in isometric view. Block 109, provides a connecting link between vessel mooring line 107, and mooring line 112, and subsequently anchor 114. As shown, block 109 comprises a bending shoe 201, a cover 202. a pin 203 in the end of cover 202 opposite from bending shoe 201. Vessel mooring line 107 is shown threaded through bending shoe 201, and mooring line 112, shown here as a chain, is shown attached to pin 203 by shackle, not shown.

In FIG. 2, bending shoe 201 is a curved hollow member having a smooth interior surface and a radius R for receiving and reversing the direction of vessel mooring line 107 without undue stress, crimping or binding. Vessel mooring line 107 passes through the interior of bending shoe 201 as indicated by vessel mooring line portions 107*a* and 107*b*. The smooth interior surface of bending shoe 201 reduces friction as vessel mooring line is pulled through. For large vessels, vessel mooring lines may be in the range of three to four inches diameter, and the bending shoe will have a radius R in the range of three to ten feet. Mooring lines may be larger and smaller than these dimensions and their bending shoes will be sized accordingly. Alternatively, bending shoe 201 in block 109 may be replaced with any convenient sheave or fairlead means, such as a closed chock.. Such alternative means, if used, have the same function as bending shoe 201.

In FIG. 2, vessel mooring line 107, which passes around bending shoe 201, is shown as a wire line. When vessel mooring line 107 is a wire line and is tensioned, rotational torque will be imposed. The direction of rotational torque on portions of vessel mooring line 107*a* and 107*b* entering and leaving bending shoe 201 are indicated by curved arrow lines 205 and 206. As can be seen, the components of rotational torque shown by arrows 205 and 206 are in opposite directions such that no net rotational torque is imposed upon block 109.

In general, chains will not absorb much twisting force, and the links tend to kink rather than rotate when a torsional twisting force is imposed. Such kinking puts undue stress on the chain links, and applying linear tension to a kinked chain may result in early failure of the stressed links at a tension well below the break strength of the chain. Wire lines used in mooring vessels are generally stranded wire or spiral wound lines. Stranded wire lines comprise a number of strands composed of a number of small wires twisted together. The strands, in turn, are twisted together to form the wire line. When such wire lines, composed of strands of twisted wire twisted to form the line, are placed under linear tension, the twisted wires and twisted strands tend to untwist, creating a rotational torque in the line. Rotational torque in the line is undesirable, as the wire line transmits this rotational torque, as a twisting force, to other components of the mooring tackle, such as the mooring and anchor chains. The amount of rotational torque generated in a tensioned wire line may be substantially reduced by various methods employed in manufacturing the line. For example, in a "regular lay" wire line, the wires in the strands are twisted in one direction, such as clockwise, and the strands are twisted together in the other direction, such as counter clockwise. In "torque balanced wire line, the wires in one strand are twisted in one direction, such as clockwise, and the wires in the next strand are twisted in the opposite direction, such as counter clockwise. Spiral wound line comprises a plurality of layers of wires with the wires of one layer being laid up with a lay angle opposite to the lay angles of wires in adjacent layers. As a result of reversing the twist on components of a wire line, under linear tension the rotational torque created by wire line components with twist in one direction will counter balance the rotational torque created by wire line components with twist in the other direction, such that the resulting rotational torque in the wire line as a whole is substantially reduced.

Vessel mooring line 107 may also be a chain. In the event that chain is used as vessel mooring line 107, preferably bending shoe will be replaced by a sheave, preferably equipped with pockets in the sheave outer periphery adapted for receiving individual links of chain for relieving bending stresses as the chain passes around the sheave. Blocks and bending shoes and sheaves which may be used, are conventional, and their specific design does not form part of the improvements of the present invention.

In FIG. 2, mooring line 112 is connected to block 109 by pin 203. Swivels, not shown, are commonly used in mooring lines to relieve rotational torque from tensioned wire lines, and to allow positioning of equipment, such as block 109 and anchor 114, in a proper attitude for deployment. Additional swivels may be employed as desired in the mooring tackle, such as at the connection of mooring line 112 and and anchor chain 113 or at the connection of anchor chain 113 with anchor 114, for relieving rotational torque and for positioning equipment. Swivels are commonly used in mooring lines, and their further description is not required for an understanding of the improvements of the present invention.

In FIG. 2, mooring line 112 may be wire line, chain, or a combination of wire lines and chains, and is designed to withstand the full mooring tension required to maintain vessel 100 moored on station within the allowed degree of excursion from the center of its station during weather and sea conditions expected. The lower end of mooring line 112 is releasably connected to anchor chain 113 by means of a swivel, (not shown), or other connection means commonly used in mooring lines. Anchor chain 113 is attached to anchor 114, (or anchor piling, not shown), by a swivel or other connecting means, for transmitting mooring tension from mooring line 112 to anchor 114. Commonly, anchor chain 113 is larger and heavier than other lines in the mooring tackle for providing additional weight which tends to maintain a portion of anchor line 113 on the sea bed 115. By this means, mooring line tension is transmitted to anchor 114 by anchor line 113 at an angle approaching horizontal, thereby increasing the holding power of anchor 114. In some instances anchor 114 may be designed to withstand larger vertical forces and maintain its holding power. When such "high uplift" anchoring means are used, additional weight on anchor chain 113 may not be required.

In FIG. 1, mooring line 112 and vessel mooring line together hang downward in a cantenary curve from fairlead 108 to the point where anchor chain 113 contacts the sea bed 115. The degree of curvature of this cantenary curve is dependent upon the weights and lengths of mooring line 112 and vessel mooring line 107, and the tension exerted on these lines.

Upon setting anchor 114 at a desired location on the sea bed and testing its holding strength, (along with setting and testing anchors for the other mooring systems on the vessel), mooring line 112 is tensioned to provide the force required to keep vessel 100 within a desired circle about the center of its station. Factors considered in determining the correct tension on mooring line 112 include: the radius of excursion which vessel 100 will be allowed about the center of its station; the weight and length of mooring line 112; the distance to anchor 114; the combination of chain and wire line in mooring line 112; clump weights and/or spring buoys attached along mooring line 112; water depth and slope of the sea bed 115 near the location of anchor 114; etc. It is desirable that the tension applied to mooring line 112 not exceed 15% to 25% of the break strength of mooring line 112 under normal weather conditions, and not exceed 50% to 60% of break strength under storm conditions.

In operation, anchor 114 and anchor chain 113 are connected to mooring line 112 and deployed at a selected location on sea bed 115.Alternatively, mooring line 112 is attached to anchor chain 113 and a preset anchor piling. Then, vessel mooring line 107 is let out sufficiently to allow block 109 to be picked up in the water below vessel hull bottom 103 and moved a desired initial distance from vessel 100, Block 109 is then attached to mooring line 112. These operations may be performed with the assistance of an attendant vessel. After this initial deployment, vessel mooring line 107 is pulled by winch 105 to ensure that anchor 114 is properly set in sea bed 115, to impose the desired mooring tension on mooring line 112, and to place block 109 at its final position. Usefully, anchor 114 is set in sea bed 115 before mooring line 112 is attached to block 109 to minimize the subsequent take up of vessel mooring line 107 by winch 105 required to properly tension mooring line 112. The amount of elongation due to tensions applied to wire lines and chains used in mooring tackle are known. Therefore, the initial position of block 109, which will result in its desired final position after mooring tension is applied, may be readily calculated using methods well known in the art.

Preferably, block 109 has a final position at a water depth below the depth to which wave action reaches. Generally, wave action reaches a depth below the water surface 111 equivalent to the height of the waves. Consequently, block 109 is preferably positioned at a water depth greater than the height of the highest expected waves. Waves, especially storm waves, generate substantial forces, and block 109 has a relatively large surface area available for action by these forces. Therefore, positioning block 109 below the depth of wave action reduces stresses in block 109 and in the mooring tackle generally.

Preferably, the final lengths of the portions 107*a* and 107*b* of vessel mooring line 107 will be sufficiently long to maintain block 109 at a desired water depth below expected wave action, and sufficiently short to maintain block 109 above sea bed 115 in the event vessel mooring line portions 107*a* and 107*b* would go completely slack such that block 109 would hang vertical down from first fairlead 108. The length of mooring line 112, for a selected mooring tension, can, in almost all cases, be selected to allow the preferred length for portions 107*a* and 107*b* of vessel mooring line 107 to be deployed. In instances where both criteria for the lengths of portions 107*a* and 107*b* of vessel mooring line 107 cannot be met, it is preferable that block 109 be maintained at a depth greater than the depth of expected wave action. In this case, reliance will be placed upon winch 105 to take up slack which may occur in vessel mooring line 107.

The advantage of the improvement of the present invention arises from the mechanical advantage provided by vessel mooring line 107 running through block 109. For a single shoe 201 in block 109, the mechanical advantage is theoretically 2. In practical application, considering the angles at which vessel mooring line 107 enters and leaves shoe 201 and friction within the system, actual mechanical advantage will be in the range of about 1.75 to 2. This mechanical advantage provided by use of block 109 allows use of less powerful pulling equipment, such as winch 105, and smaller vessel mooring lines 107 than would otherwise be required with conventional mooring systems. For example, to provide a maximum tension of 500,000 pounds on mooring line 112, use of the improvement of the present invention allows use of pulling equipment, (winch 105), with only about 286,000 pounds pulling power. Likewise, for a mooring line 112 having a break strength of 1,000,000 pounds, (to provide a safety factor for the 500,000 pound tension), a vessel mooring line 107 having a break strength of only 572,00 pounds is required. As has been discussed above, a particular advantage of the improvement of the present invention is that mooring strength of existing mooring systems may be increased up to about 1.75–2 times without replacement of on board mooring equipment. Addition of block 109, use of stronger tackle from block 109 to anchor 114, and use of a larger anchor 114 is substantially less expensive than replacing the entire mooring system. Savings are, of course multiplied by the number of mooring systems on vessel 100.

A preferred embodiment of the improvements of the present invention is described in this specification. Other embodiments, variations and modifications which are within the spirit and scope of the present invention will occur to those skilled in the art, which embodiments, variations and modifications are intended to be included within the present invention, and no limitations to the present invention are intended except limitations contained in the appended claims.

We claim:

1. In a mooring system for mooring a vessel, having a hull with a waterline and a turret extending through the hull, in a body of water, having a water surface and a bottom at a depth beneath the water surface, in a mooring area subject to waves which generate a wave action which extends below the water surface, said mooring system comprising: a vessel mooring line having a free end; pulling equipment located within the turret and attached to the vessel mooring line, for extending, retracting and tensioning the vessel mooring line; mooring tackle having a first end and a second end; and anchor means for anchoring the vessel to the bottom connected to the second end of the mooring tackle, the improvement which comprises:

a) a first fairlead attached to the turret below the vessel hull for receiving the vessel mooring line first end from the pulling equipment and freely passing the vessel mooring line outward from the vessel;

b). a block, located a distance away from the vessel hull, and comprising block fairlead means for receiving and freely passing the vessel mooring line extended from the pulling equipment, and further comprising block connecting means for connecting the block to the first end of the mooring tackle; and c). a second fairlead attached to the turret below the vessel hull at a position laterally spaced from the first fairlead, for receiving and freely passing the vessel mooring line from the block fairlead for attachment to the vessel.

2. The improvement of claim 1, including the block fairlead means comprising a bending shoe.

3. The improvement of claim 1, including:

the mooring tackle and vessel mooring line together having a length sufficient to maintain the block at a water depth below the depth to which wave action may be expected to extend in the mooring area.

4. The improvement of claim 1, including:

the anchor means comprising an anchor chain having an end connected to the mooring tackle; and the vessel mooring line and the mooring tackle defining a catenary, from the first fairlead to the anchor chain, having a curve sufficient to maintain the block at a water depth below the depth to which wave action may be expected to extend in the mooring area.

* * * * *